US005113584A

United States Patent [19]

Wenzel

[11] Patent Number: 5,113,584

[45] Date of Patent: May 19, 1992

[54] PROCESS FOR MANUFACTURING AN ASYMMETRIC PULLEY FROM A METAL DISK

[75] Inventor: Helmut Wenzel, Beckum, Fed. Rep. of Germany

[73] Assignee: Leifeld GmbH & Co., Ahlen, Fed. Rep. of Germany

[21] Appl. No.: 621,243

[22] Filed: Feb. 4, 1991

[51] Int. Cl.[5] ..... B21K 1/42

[52] U.S. Cl. ..... 29/892; 474/166; 474/168

[58] Field of Search ..... 29/892, 892.11, 894.32, 29/894.324; 474/166, 168; 72/68

[56] References Cited

U.S. PATENT DOCUMENTS 4,874,353 10/1989 Matsuoka et al. ..... 474/168
4,936,129 6/1990 Lipper et al. ..... 72/68

FOREIGN PATENT DOCUMENTS 0204032 12/1985 European Pat. Off. .
30541 2/1985 Japan ..... 29/892
278919 11/1989 Japan ..... 29/894.324

*Primary Examiner*—P. W. Echols
*Attorney, Agent, or Firm*—Felfe & Lynch

[57] ABSTRACT

The hub part of a flat disk is clamped between the jaws of a chuck and a protruding circumferential part is formed against the chuck by a roller so that the formed material is distributed axially off-center with respect to the hub part. The formed material is then flattened by a further roller to form a cylindrical preform which is likewise axially off center with respect to the hub part. The preform is formed by a last roller to provide a circumferential area with a final profile for guiding a belt.

2 Claims, 1 Drawing Sheet

PROCESS FOR MANUFACTURING AN ASYMMETRIC PULLEY FROM A METAL DISK

BACKGROUND OF THE INVENTION

A process of this kind is known from published EP-A 0 204 032. This process determines that a disk is partly compressed in its circumferential area, the circumferential area is then split, the split area is expanded and compressed again, if required, and subsequently provided with a profile. For the manufacture of asymmetric pulleys, provision is made for the compressed circumferential area to be split off-center such that the resulting two collars have different wall thicknesses.

A disadvantage of this known process resides in that, during manufacture, the asymmetric splitting poses problems due to uneven forces occurring at the disk. Due to these uneven forces, the collars of the circumferential area of the disk resulting from the splitting may easily exhibit irregular structural properties and, hence, irregular strength properties. This is disadvantageous to the continued processing and to the service life of the finished product.

SUMMARY OF THE INVENTION

The object of the invention is to provide a process of the aforesaid kind by means of which an asymmetric pulley of uniform strength properties can be manufactured easily and with a reduced amount of labor and cost.

The invention relates to a process for manufacturing a pulley having a circumferential area for guiding a belt and a disk-like hub part which is axially off center with respect to the circumferential area.

In this new process, the one or several steps necessary to provide the required asymmetry of material distribution of the circumference of the disk are carried out by partially compressing the circumferential area at the beginning of the process. Moreover, the expensive and problematic splitting procedure can be omitted, which substantially simplifies the entire process. The structural configuration of the disk in its circumferential area hence remains very uniform since the asymmetrically partially compressed circumferential area, despite its asymmetry, always has a compact form with relatively large wall thicknesses which allows a comparatively simple continuation of the processing. Also included in the processing is an operating step where the material, in order to be distributed in the circumferential area in the desired asymmetric form, is subject to flattening. This contributes to an increased protection of the material during the entire forming process and practically excludes weaknesses in the structural constitution of the circumference of the disk caused by excessive stress and/or too small a material thickness caused during the processing. This in turn enhances the quality, in particular the stress reliability, as well as the long-term service life of the finished product.

A further improvement of the new process determines that the partial compression be carried out in several steps providing an increasing asymmetry in material distribution and/or in thickness of the disk relative to the hub. The material of the disk and the machinery for the working of the process are thus less subject to stress.

The final profile can be provided in a known manner wherein the finished product is a flat-belt pulley, a V-belt pulley, a toothbelt pulley or a poly-V pulley.

DETAILED DESCRIPTION OF THE PREFERRED EMBODIMENT

Figure 3:
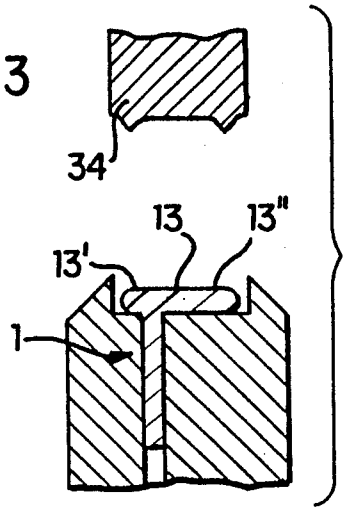
FIG. 3 shows the disk of FIG. 2 following a flattening of the circumferential area, FIG. 4 show the disk of FIG. 3 after preprofiling

All the figures are cross sections showing a metal disk 1 tightly clamped between the jawa 21 and 22 of a clamping chuck. Together with disk 1, the clamping chucks 21 and 22 can be rotated around an axis running perpendicular to the plane of the disk, i.e. in the plane of the drawing. Further, above the disk 1, FIGS. 1 to 4 show forming tools which are rollers of various contours. Each of these rollers can also be rotated around an axis of rotation which, in the plane of drawing, runs parallel to the axis of rotation of the clamping jaws 21 and 22. Moreover, the plane of drawing, they can be adjusted in direction toward the disk 1.

Figure 1:
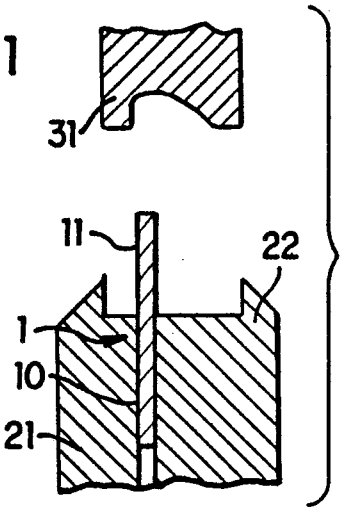
FIG. 1 shows the disk prior to the processing of its circumferential area together with a first forming tool.

FIG. 1 shows the disk 1 in a situation at the beginning of the process where it still has its original shape. The disk 1 is configured as a flat disk with a centered hub area 10 and radially external circumferential part 11. In the center part of the hub area 10, provision is made for a recess which will later receive a mounting axle, for example.

The top of FIG. 1 shows a first forming tool, which, in this case, is a roller 31 of an asymmetric outer contour providing a first compression.

Figure 2:
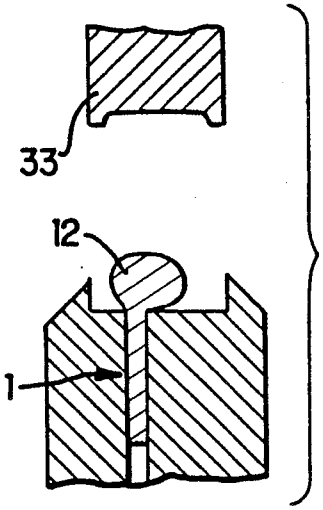
FIG. 2 shows the disk of FIG. 1 subsequent to an asymmetric partial compression of the circumferential area.

FIG. 2 shows the asymmetric circumferential area 12 of disk 1 after being partially compressed by means of roller 31. Relative to the hub part 10 of disk 1, the material in the circumferential area 12 is now asymmetrically distributed.

The asymmetric partial compression of the circumferential area 12 is continued by means of an additional forming tool which in this case is a flattening roller 33.

FIG. 3 shows the disk 1 after the flattening by roller 33. As seen in FIG. 3, disk 1 now has a flattened circumferential area 13 with two hollow cylindrical pieces 13' and 13" of different widths. Further, FIG. 3 shows a preprofiling roller 34 to be used in the continued processing of the circumferential area 13 of disk 13 following FIG. 3.

Figure 4:
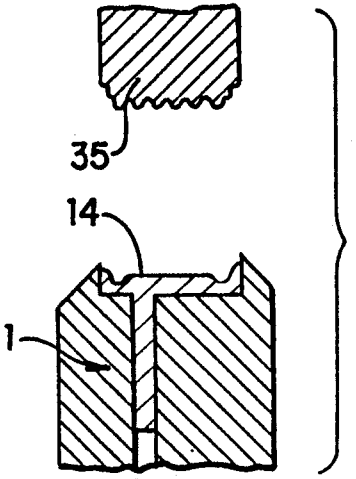

The result of this next forming step is shown in FIG. 4. In order to obtain a best-possible material distribution toward the final profile, disk 1 was now provided with apreprofile circumferential area 14 having two radially protruding axial bars at the outermost side edges of the outer surface of the circumferential area 14. And, further, it has two parallel circumferential grooves immediately following these bars toward the inside.

Figure 5:
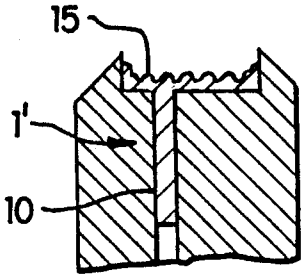
FIG. 5 shows the disk of FIG. 4 after the final profiling.

The final profiling of disk 1 into a complete pulley, a poly-V-belt pulley 1' in this case, is provided by means of a final profiling roller 35 used as a last forming tool in this process. This is represented in the top portion of FIG. 4. The finished product of the process, the poly-V-belt pulley 1' having the circumferential area 15 with the final profile, is shown in FIG. 5. As clearly seen in FIG. 5, the product is an asymmetric pulley 1', i e. hub part 10 is disposed axially off-center with respect to the circumferential area 15. On its outside, the circumferential area 15 of the finished pulley 1' has the parallel running grooves provided for holding a poly-V-belt.

I claim:

1. Process for manufacturing a pulley having a circumferential area for guiding a belt and a disk-like hub part which is axially off center with respect to said circumferential area, comprising providing a flat disk having a central hub part with an axis perpendicular thereto and a radially external circumferential part, said disk made of a formable material, clamping said hub part in chuck means so that said circumferential part protrudes from said chuck means, compressing said circumferential part without splitting the material so that the material of said circumferential part is distributed axially off-center with respect to said hub part, further compressing to flatten the material of said circumferential part to form a cylindrical preform for the circumferential area of the pulley, said cylindrical preform being axially off-center with respect to said hub part, and forming a final profile for guiding said belt into said preform.

2. Process in accordance with claim 1 wherein said compressing without splitting the material is carried out in several steps which distribute the material of the circumferential part progressively more axially off-center with respect to said hub part.

* * * * *